United States Patent [19]

Umphrey et al.

[11] B 3,998,396

[45] Dec. 21, 1976

[54] SCALPING APPARATUS FOR A LOW PROFILE TWO-ROLL CRUSHER

[75] Inventors: Ronald W. Umphrey; David L. McCain, both of Ponca City, Okla.

[73] Assignee: Continental Oil Company, Ponca City, Okla.

[22] Filed: Dec. 17, 1973

[21] Appl. No.: 425,462

[44] Published under the second Trial Voluntary Protest Program on March 9, 1976 as document No. B 425,462.

[52] U.S. Cl. ..... 241/81; 209/10; 209/261; 209/257

[51] Int. Cl.[2] ..... B02C 23/08

[58] Field of Search ..... 209/307, 308, 247, 261; 241/81, 69, 76, 78, 80, 10, 257

[56] References Cited

UNITED STATES PATENTS

| | | | |
|---|---|---|---|
| 555,533 | 3/1896 | Randolph | 209/307 |
| 1,715,197 | 5/1929 | Grabill | 209/307 X |
| 1,791,365 | 2/1931 | Lieu | 209/307 |
| 2,292,650 | 8/1942 | Oehler | 209/247 X |
| 2,974,797 | 3/1961 | Blackman | 209/307 |
| 3,016,203 | 1/1962 | Sears | 241/24 |
| 3,280,977 | 10/1966 | Luken | 209/307 |
| 3,510,073 | 6/1967 | Mailliard | 24/81 |

FOREIGN PATENTS OR APPLICATIONS

| | | | |
|---|---|---|---|
| 845,700 | 6/1970 | Canada | 241/69 |
| 662,777 | 12/1951 | United Kingdom | 209/247 |
| 239,785 | 7/1969 | U.S.S.R. | 241/76 |

*Primary Examiner*—Robert Halper
*Attorney, Agent, or Firm*—William J. Miller

[57] ABSTRACT

In a low profile crusher which has first and second cylindrical rolls journaled so that the rotational axis of the rolls are parallel and an input conveyor and an output conveyor is improved by journaling the first roll so that the distance from the axis of the first roll to the product side of the output conveyor is slightly greater than the radius of the first roll. The input conveyor is mounted over the first roll so that the distance between the axis of the first roll and the return side of the input conveyor is slightly greater than the radius of the first roll. The second roll is journaled above the first roll so that the maximum height of the second roll is at least equal to the height of the product side of the input conveyor and close enough to the first roll to produce a predetermined maximum size of product. A scalping method for the above is formed by mounting the input end of the input conveyor in substantially the same plane as the output conveyor. The mounting for the input of the output conveyor is under the input conveyor and a grating is mounted under the input conveyor so that at least a portion of the product of a predetermined maximum size or smaller on the input conveyor falls to the output conveyor and does not pass to the crusher.

5 Claims, 4 Drawing Figures

SCALPING APPARATUS FOR A LOW PROFILE TWO-ROLL CRUSHER

BRIEF DESCRIPTION OF THE PRIOR ART

Scalping devices for crushers are exemplified by the following patents: Nos. 1,798,433 to E. L. Rigdon et al; 2,210,093 to S. J. Morrissey; 2,468,321 to J. Bland; 2,631,785 to N. H. Bogie; 3,003,708 to J. W. Leonard; U.S. Patents Nos. 3,016,203 and 3,112,078 to C. G. Sears et al; 3,493,266 to E. D. Hazlitt et al; 3,409,235 to J. N. Quinn; and 3,510,073 to R. P. Mailliard. All of the above patents have one thing in common. The scalping units are either mounted horizontally or inclined downard toward the crushing unit so that as the conveyors move the material, they will be moving with gravity. Some of the conveyors utilize bars to move the material over the scalping unit, and some of the conveyors use vibration to move the materials over the scalping unit. However, in all cases, the scalping units are either horizontal or directed down toward the crushing unit. Some of the prior art patents utilize conveyors to lift the material to the scalping units. None of the patents, however, disclosed illustrate a scalping unit which can be utilized with the two-roll crusher so that the unit will provide minimum height for both the scalping unit and the two-roll crusher.

BRIEF DESCRIPTION OF THE INVENTION

This invention describes a scalping unit which is utilized in conjunction with a two-roll crushing unit which is designed to provide minimum height so that the crushing unit can be used inside a mine tunnel. The scalping unit utilized with the low profile tworoll crusher has a specific placement of the inlet and outlet conveyors and the first and second roll crushing units. In order to obtain minimum profile, it is important that the return side of the outlet conveyor and the product side of the inlet conveyor comprise the least height possible. The conveyor of this invention is adapted to be positioned in a coal mine following a coal digging machine so that the coal can be sized from the digging machine and fed to a system for slurrying the coal out of the mine. Such a possible slurry system is disclosed in the patent to Eric Reichl U.S. Pat. No. 3,260,548. The scalping unit is designed to pick the coal from a hopper or from a shuttle car, or directly from the continuous mining machine and convey the coal to the two-roll crusher. In the process of conveying the coal, the smaller pieces of coal are separated out by the scalping unit, thereby reducing the overall quantity directed to the two-roll crusher and reducing the horsepower per ton required to size the coal.

DETAILED DESCRIPTION OF THE SCALPING UNIT

Figure 1:
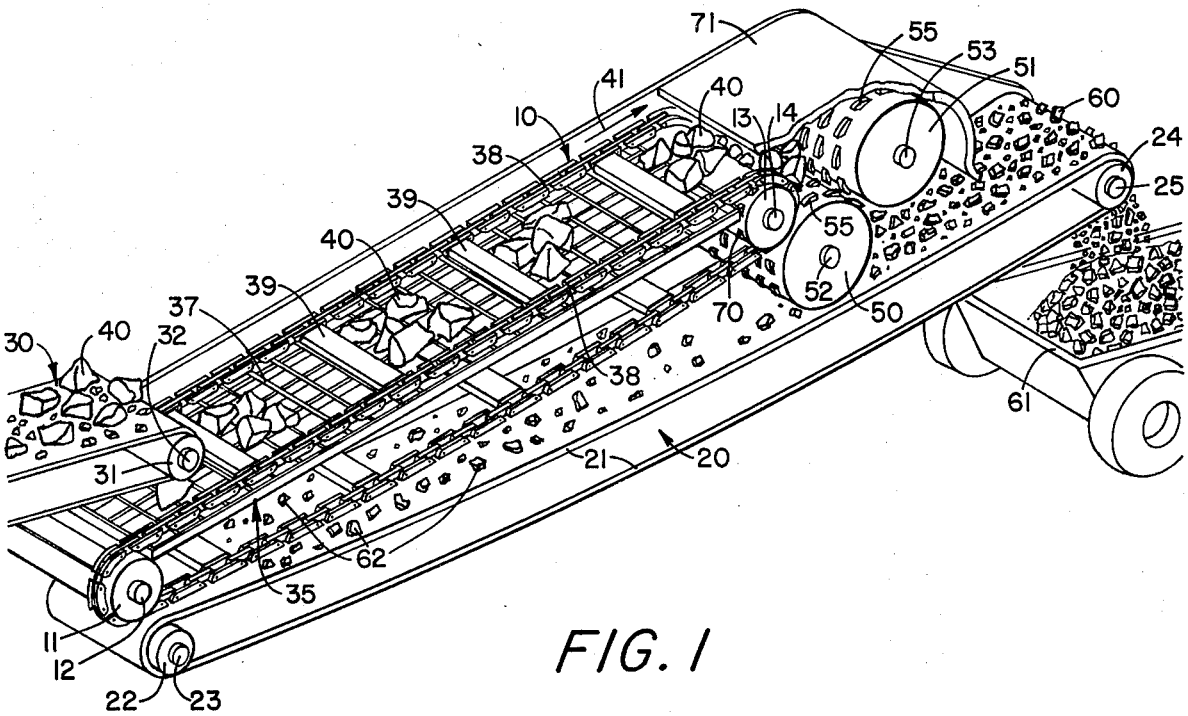
FIG. 1 is a perspective view with the exposed side removed showing the scalping unit in conjunction with a two-roll crushing unit.

Referring to the drawings but in particular to FIG. 1, a perspective view of the scalping unit in conjunction with a two-roll crusher is illustrated. The scalping unit essentially comprises an input conveyor 10 driven by a first roll 11 journaled on a shaft 12 and a second roll 13 journaled on a shaft 14. The output conveyor generally referred to by the number 20 comprises a belt 21 supported by a first roller 22 journaled on a shaft 23 and a second roller 24 journaled on a second shaft 25. Conveyor 10 is fed by conveyor 30 which is supported by a roller 31 which in turn is journaled on a shaft 32. The bearings for shaft 32, 22, and 25 are not illustrated for purposes of better illustrating the mounting and operation of the various conveyors. A second roller for conveyor 30 is not shown but supports the other end of conveyor 30. Conveyors 20 and 30 are illustrated as belts. However, any form of conveyor can be used which can successfully move the product such as a chain-driven conveyor, vibrator conveyor, or other well known types. The input or scalping conveyor 10 comprises a grid 35 which comprises a plurality of long support members 36 and a plurality of cross members 37. On each side of conveyor 10 is a chain 38, having attached there between a plurality of cross members 39. These cross members 39 are such that they will ride along the top of grid 35, pulling product 40 along the conveyor in the direction of arrow 41. The terminus of conveyor 10 permits the product to drop between two rolls 50 and 51 which are journaled on shafts 52 and 53, respectively. Each of the rolls 50 and 51 contain a plurality of peripheral teeth 55 used to break the product 40 as it passes between the rolls 50 and 51. The crushed product after passing between rolls 50 and 51 falls onto conveyor 21 as a sized product 60 which in turn passes over the terminus of output conveyor 20 and into a cart for example 61. The spacing between grid 36 is such that the smaller product 62 falls through the holes or openings in grid 36 and onto the upper surface of output conveyor 20. A guard 71 prevents crushed material or broken material which may tend to be flung from the rollers from injuring personnel in the close vicinity of the unit. The operation of the scavenge unit in FIG. 1 is as follows: Product 40 on conveyor 30 passes from its terminus and falls onto conveyor 10. Cross members 39 which are being pulled by chain 38 move the product along grid 36. Any small product having a dimension smaller than the spacing between vertical members 36 and cross members 37 will fall through the opening and onto the upper surface of conveyor 20. This smaller product 62 will pass to the terminus of conveyor 20 and into cart 61. The large product 40 will continue up grid 35 until it reaches roll 13 where it will pass or fall between crusher rolls 50 and 51. Teeth 55 on each roll will size the product as it passes between the rolls. The sized product will fall onto conveyor 20, pass onto cart 61. It should be noted at this point that conveyor 20 has its upper surface as close as possible to the bottom of roll 50, and the upper surface of conveyor 10 including the product does not exceed the height of roll 51. Rolls 50 and 51 are positioned so that the height of the overall unit will be minimum. A plurality of sprocket teeth 70 may be attached to roll 13 so that teeth 70 can engage the spacing between the chain lengths of chain 38, thereby providing a drive for the chain. The motors used in driving conveyors 30, 10, 20 and rolls 51 and 50 are not illustrated for the purpose of simplicity. The drive mechanisms for the conveyors and roll crushers or sizers are well known in the art.

Figure 2:
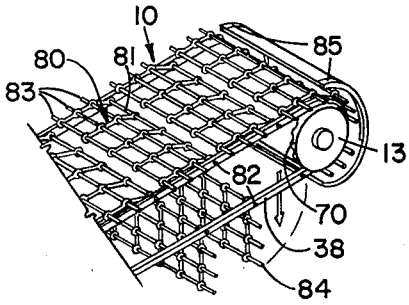
FIG. 2 illustrates a modification of the conveyor used in the system described in FIG. 1.

The device shown in FIG. 2 illustrates another method of providing a grid in combination with a conveyor belt. Referring to the drawing, a chain 38 is driven by roll 13 which has a plurality of sprockets 70 thereon which engage the links of chain 38. A plurality of hinged grids 80 has one edge rod 81 pivotally attached at 82 to chain 38. The remaining rods 83 have a plurality of projections 84 which provide support for rods 83 against chain 38 when the small grids 80 are on the top side of chains 38. When the grids 80 are on the underside of chain 38, rods 84 no longer are supported by chain 38 and hang in the manner illustrated in the drawing. This construction permits the product to fall from the upper surface through the grid and through the underside of the conveyor 10. Strips 85 retain the grid rods 83 against roller 13 until the conveyor has passed to the underside of roller 13. The construction prevents premature releasing of the rods 83 from roller 13 and thereby controls the dropping point of the product between rolls 50 and 51.

Figure 3:
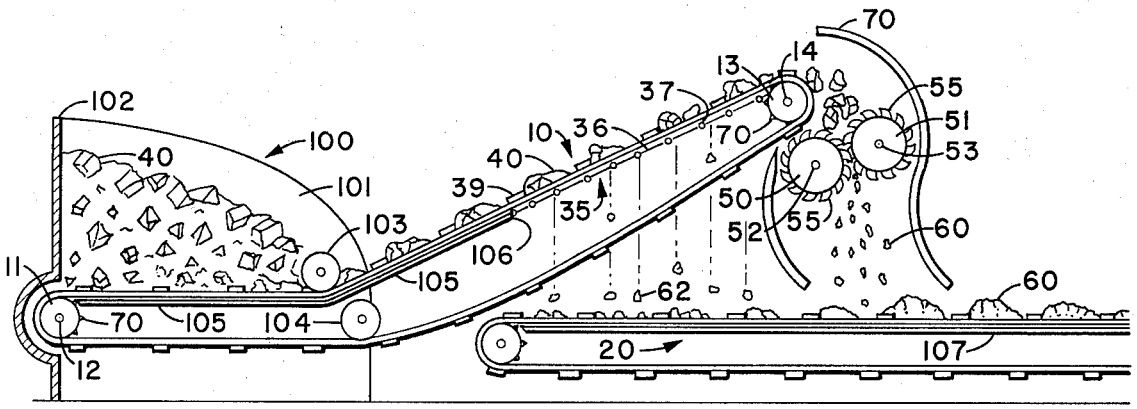
FIG. 3 is a schematic of a scalping unit in conjunction with a surge hopper mechanism.

In order to control surge in a system such as that shown in FIG. 1, the scalping unit can be mounted as illustrated in FIG. 3 which includes a hopper 100 having sidewalls 101, a rear wall 102, with roller 11 journaled about shaft 12 in the sidewalls 101 of hopper 100. Guide wheels 103 and 104 help control the movement of conveyor 10. An underplate 105 prevents product 40 from falling through the conveyor in hopper 100 and through conveyor 10 before conveyor 20 is reached; therefore, plate 105 extends to point 106 which is above conveyor 20. The system as shown in FIG. 3 operates exactly the same as the system shown in FIG. 1 except that an input conveyor 30 is not needed. It also provides a method for loading conveyor 10 on an intermittent basis while conveyor 10 can be operated on a substantially continuous basis. As the product 40 moves up conveyor 10 over grid 35, the smaller products 62 will fall to conveyor 20. In this figure, conveyor 20 is illustrated as having a chain drive with cross members connected between the chains. The conveyor is constructed in the identical manner as the conveyor illustrated for the scalping unit 10. The only difference is that the conveyor includes a bottom 107 which prevents materials 60 from falling through conveyor 20.

Figure 4:
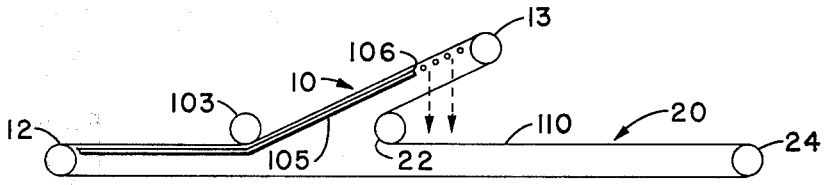
FIG. 4 is an alternate method for driving the inlet and outlet conveyor systems.

FIG. 4 illustrates an alternative belt or chain drive for the conveyor illustrated in FIGS. 2 or 3. In this instance, a continuous chain or belt 110 being driven by rollers 12, guide wheels 103, roller 13, roller 22, and roller 24 such as that illustrated in FIGS. 1 and 3. In the instance of FIG. 4, plate 105 is positioned under the conveyor and extends to 106 so that the scalping will not take place until the conveyor is over conveyor 20.

A scalping unit for a two-roll crusher has been illustrated which is compact and operates in a manner to separate the smaller product from the large product prior to the entry of the larger product to a two-roll crusher. The conveyors afford a unique positioning with the two-roll crusher so that minimum height can be achieved with the combination. The minimum height provides a means for making a compact unit which can be taken into a mine. Such a system when in the mine will afford a method for sizing product prior to its entry into a slurry line. While a cart 61 has been disclosed, for simplicity, it is obvious that other apparatus could receive the output from the conveyor, for example, another conveyor, or a slurry hopper, or the material could be piled and picked up either intermittently or continuously. A particular embodiment has been disclosed. It is obvious that other embodiments can be used which are well within the skill of the art. Such alternate embodiments are fully contemplated by this invention as disclosed in the specification and appended claims.

What we claim is:

1. A low profile apparatus for scalping and crushing products comprising first and second cylindrical roll crushers journaled so that the rotational axes of said first and second cylindrical rolls are parallel and having a first and second radius, respectively; an input conveyor and an output conveyor each having a products side and a return side; means for journaling said first cylindrical roll so that the distance from the axis of said first cylindrical roll to the products side of said output conveyor is slightly greater than the radius of said first cylindrical roll; means for mounting said input conveyor over said first cylindrical roll so that the distance between the axis of said first cylindrical roll and the return side of said input conveyor is slightly greater than the radius of said first cylindrical roll; means for journaling said second cylindrical roll above said first cylindrical roll so that the maximum height of said second cylindrical roll is at least equal to the height of the products side of said input conveyor and less than the maximum height of any products on said products side of said conveyor; means for mounting the input end of said input conveyor in substantially the same plane as said output conveyor; means for mounting said output conveyor under said input conveyor; and scalping means for passing product of a predetermined maximum size or smaller from said input conveyor to said output conveyor said input conveyor conveying product above said predetermined size to said first and second roll crushers wherein it is sized and passed to said output conveyor.

2. An apparatus as described in claim 1 wherein said means for passing said product of a predetermined maximum size or smaller from said input conveyor to said output conveyor comprises:

a. a grid having sized openings therethrough;
b. means for mounting said grid under said input conveyor; and
c. means for pulling said product over said grid.

3. An apparatus as described in claim 1 including a storage hopper surrounding the input to said input conveyor.

4. An apparatus as described in claim 1 wherein said input and said output conveyors comprise a single continuous belt.

5. An apparatus as described in claim 1 wherein said input and said output conveyors comprise a continuous pair of parallel chains having a plurality of cross members spaced therebetween and secured to said chains.

* * * * *